US008183191B2

(12) United States Patent
Kinoshita et al.

(10) Patent No.: US 8,183,191 B2
(45) Date of Patent: May 22, 2012

(54) GREASE COMPOSITION

(75) Inventors: Hirotsugu Kinoshita, Yokohama (JP); Souichi Nomura, Tokyo (JP); Takashi Arai, Yokohama (JP); Kiyomi Sakamoto, Yokohama (JP)

(73) Assignee: Nippon Oil Corporation, Tokyo (JP)

( * ) Notice: Subject to any disclaimer, the term of this patent is extended or adjusted under 35 U.S.C. 154(b) by 668 days.

(21) Appl. No.: 10/512,584

(22) PCT Filed: Apr. 22, 2003

(86) PCT No.: PCT/JP03/05115

§ 371 (c)(1),
(2), (4) Date: Jun. 1, 2005

(87) PCT Pub. No.: WO03/091368

PCT Pub. Date: Nov. 6, 2003

(65) Prior Publication Data

US 2005/0209115 A1 Sep. 22, 2005

(30) Foreign Application Priority Data

Apr. 26, 2002 (JP) ..... P2002-127132

(51) Int. Cl.
*C10M 133/20* (2006.01)
*C10M 137/02* (2006.01)
*C10M 129/00* (2006.01)

(52) U.S. Cl. ..... 508/528; 508/442; 508/557; 508/552

(58) Field of Classification Search ..... 508/552, 508/442, 528, 577
See application file for complete search history.

(56) References Cited

U.S. PATENT DOCUMENTS

| | | | | |
|---|---|---|---|---|
| 2,419,325 | A * | 4/1947 | Musselman | 508/317 |
| 4,582,617 | A * | 4/1986 | Doner et al. | 508/185 |
| 4,840,740 | A | 6/1989 | Sato et al. | |
| 5,104,558 | A * | 4/1992 | Matsuzaki | 508/220 |
| 5,160,645 | A * | 11/1992 | Okaniwa et al. | 508/356 |
| 5,207,935 | A | 5/1993 | Waynick | |
| 5,464,548 | A * | 11/1995 | Cahoon et al. | 508/186 |
| 5,607,906 | A | 3/1997 | Okaniwa et al. | |
| 5,728,659 | A * | 3/1998 | Naka et al. | 508/552 |
| 5,854,183 | A | 12/1998 | Hasegawa et al. | |
| 5,955,404 | A * | 9/1999 | Horodysky et al. | 508/294 |
| 6,037,314 | A * | 3/2000 | Kondo et al. | 508/363 |
| 6,306,801 | B1 | 10/2001 | Yagishita et al. | |
| 6,352,961 | B1 * | 3/2002 | Iso et al. | 508/155 |
| 6,355,602 | B1 | 3/2002 | Okaniwa et al. | |
| 6,417,143 | B1 * | 7/2002 | Mikami et al. | 508/465 |
| 2002/0013232 | A1 * | 1/2002 | Kinoshita et al. | 508/364 |

FOREIGN PATENT DOCUMENTS

| | | | |
|---|---|---|---|
| EP | 0 386 653 | A1 | 9/1990 |
| EP | 0 386 653 | B1 | 9/1990 |
| EP | 0 773 280 | A2 | 5/1997 |
| GB | 2 255 346 | A | 11/1992 |
| GB | 2 323 851 | A | 10/1998 |
| JP | 02-232297 | | 9/1990 |
| JP | 2-232297 | | 9/1990 |
| JP | 08 165488 | | 6/1996 |
| JP | 9-194871 | | 7/1997 |
| JP | 11012589 | A * | 1/1999 |
| JP | 11 181465 | | 7/1999 |
| JP | 2002-180077 | | 6/2002 |
| JP | 2003-013973 | | 1/2003 |
| WO | WO 94/03565 | | 2/1994 |

* cited by examiner

*Primary Examiner* — Jim Goloboy
(74) *Attorney, Agent, or Firm* — Finnegan, Henderson, Farabow, Garrett & Dunner, LLP

(57) ABSTRACT

A grease composition containing a lubricant base oil, diurea compounds represented by the following general formulas (1) to (3), and at least one species selected from the group consisting of paraffin oxides and phosphorus compounds; wherein respective contents of the diurea compounds represented by the following general formulas (1) to (3) satisfy conditions defined by the following expressions (4) and (5); and wherein the total content of the paraffin oxides and phosphorus compounds is 0.1 to 15 mass % based on the total amount of the grease composition:

(1)

$$R^1-NHC(=O)NH-R^2-NHC(=O)NH-R^1$$

(2)

$$R^1-NHC(=O)NH-R^2-NHC(=O)NH-R^3$$

(3)

$$R^3-NHC(=O)NH-R^2-NHC(=O)NH-R^3$$

where $R^1$ is a hydrocarbon group containing an aromatic ring, $R^2$ is a divalent hydrocarbon group, and $R^3$ is a hydrocarbon group containing an aliphatic ring;

$$5 \leqq W_1+W_2+W_3 \leqq 30 \quad (4)$$

$$0.3 \leqq (W_1+0.5\times W_2)/(W_1+W_2+W_3) \leqq 0.7 \quad (5)$$

where $W_1$, $W_2$, and $W_3$ are respective contents (mass %) of the diurea compounds represented by general formulas (1) to (3) based on the total amount of the grease composition.

3 Claims, No Drawings

GREASE COMPOSITION

TECHNICAL FIELD

The present invention relates to a grease composition; and, more specifically, to a grease composition useful for preventing fretting wear (micromotion wear) from occurring in sliding parts, joint parts, etc. in elements aimed at restricting relative motion or in elements susceptible to minute reciprocation.

BACKGROUND ART

A wear phenomenon (hereinafter referred to fretting) known as micromotion wear in general occurs in various mechanical elements such as elements aimed at restricting the relative motion, e.g., shaft engaging parts, bolt joint parts, rivet joint parts, and tapered couplings, or elements accompanying minute reciprocation, e.g., rolling bearings, sliding bearings, ball bushings, spline shafts, flexible shaft couplings, universal joints, constant velocity joints, leaf springs, coil springs, electric contacts, valves with valve seats, and wire ropes. When transporting cars in particular, long-distant transportation is carried out by trailers and freight trains, whereby minute vibrations during the transportation cause fretting in bearing transfer surfaces, which is problematic.

Therefore, various methods have been under consideration in order to keep such a phenomenon from happening. One of such methods proposed chooses an appropriate lubricant, so as to prevent fretting from occurring.

Meanwhile, though a fretting prevention method using grease as a lubricant has been reported, the fretting resistance of greases has not fully been elucidated yet. For example, there are cases where greases in which the same thickener is compounded yield results contrary to each other concerning the fretting resistance depending on test methods. Also, though there have been many reports stating that additives containing phosphorus compounds such as phosphates and phosphate esters are preferred, their fretting resistance properties vary greatly depending on structures of the phosphorus compounds.

On the other hand, the inventors have found that a grease containing a compound (so-called urea type thickener) selected from the group consisting of urea-urethane compounds and urethane compounds, and a compound selected from the group consisting of paraffin oxides, diphenyl hydrogen phosphite, and hexamethylphosphoric triamide is excellent in the resistance to fretting, and disclosed this finding in Japanese Patent Application Laid-Open No. HEI 02-232297.

DISCLOSURE OF THE INVENTION

However, there are cases where the above-mentioned conventional grease fails to exhibit a sufficient resistance to fretting. Also, in general, urea type thickeners tend to become harder as time passes.

Though lithium soap and the like have been known as thickeners which are less likely to become harder, it is quite difficult to attain a sufficient fretting resistance by using these thickeners, and the heat resistance of the grease deteriorates when such a thickener is added thereto.

In view of the problems of the prior art mentioned above, it is an object of the present invention to provide a grease composition which exhibits an excellent resistance to fretting and is less likely to become harder.

The inventors conducted diligent studies in order to achieve the above-mentioned object and, as a result, have found that a grease composition in which specific diurea compounds and at least one of a paraffin oxide and a phosphorus compound are compounded by respective predetermined compounding ratios into a lubricant base oil is excellent in preventing fretting wear from occurring in sliding parts and joint parts in elements aimed at restricting relative motion and in elements susceptible to minute reciprocation, and is less likely to become harder as time passes, thereby completing the present invention.

Namely, the grease composition of the present invention contains a lubricant base oil, diurea compounds represented by the following general formulas (1) to (3), and at least one species selected from the group consisting of paraffin oxides and phosphorus compounds; wherein respective contents of the diurea compounds represented by the following general formulas (1) to (3) satisfy conditions defined by the following expressions (4) and (5); and wherein the total content of the paraffin oxides and phosphorus compounds is 0.1 to 15 mass % based on the total amount of the grease composition:

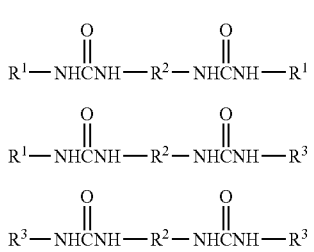

(1)

(2)

(3)

where $R^1$ is a hydrocarbon group containing an aromatic ring, $R^2$ is a divalent hydrocarbon group, and $R^3$ is a hydrocarbon group containing an aliphatic ring;

$$5 \leqq W_1 + W_2 + W_3 \leqq 30 \quad (4)$$

$$0.3 \leqq (W_1 + 0.5 \times W_2)/(W_1 + W_2 + W_3) \leqq 0.7 \quad (5)$$

where $W_1$, $W_2$, and $W_3$ are respective contents (each expressed by the unit of mass %) of the diurea compounds represented by general formulas (1) to (3) based on the total amount of the grease composition.

BEST MODES FOR CARRYING OUT THE INVENTION

In the following, preferred embodiments of the present invention will be explained in detail.

Examples of the lubricant base oil used in the grease composition of the present invention are mineral oils and/or synthetic oils.

Examples of the mineral oils are those obtained by a method usually carried out in a lubricant manufacturing process in a petroleum refining industry, more specifically, those obtained when a lubricant fraction yielded by distilling a crude oil under normal pressure and under reduced pressure is refined by carrying out at least one of processes of solvent deasphalting, solvent extraction, hydrocracking, solvent dewaxing, contact dewaxing, hydro-refining, washing with sulfuric acid, clay treatment, etc.

Specific examples of the synthetic oils include poly α-olefins such as polybutene, 1-octene oligomer, and 1-decene oligomer or their hydrogenated products; diesters such as ditridecyl glutarate, di(2-ethylhexyl)adipate, diisodecyl adipate, ditridecyl adipate, and di(3-ethylhexyl)sebacate; polyol esters such as trimethylolpropane caprylate, trimethylolpropane pelargonate, pentaerythritol 2-ethylhexanoate, and pentaerythritol pelargonate; aromatic ester oils such as trioctyl trimellitate, tridecyl trimellitate, and tetraoctyl pyromellitate; complex esters which are esters formed by a mixed fatty acid of a dibasic acid and a monobasic acid, and a polyhydric alcohol; alkyl naphthalene; alkyl benzene; polyoxyalkylene glycol; polyphenyl ether; dialkyldiphenyl ether; silicone oil; and their mixtures.

The kinetic viscosity of the lubricant base oil at 100° C. is preferably 2 to 40 $mm^2/s$, more preferably 3 to 20 $mm^2/s$. The viscosity index of the base oil is preferably at least 90, more preferably at least 100.

In the present invention, diurea compounds represented by the following general formulas (1) to (3) are added as a thickener to the lubricant base oil:

(1)

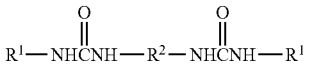

(2)

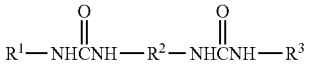

(3)

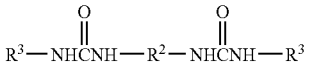

In the above-mentioned formulas (1) to (3), $R^1$ is a hydrocarbon group containing an aromatic ring. Examples of such a group include phenyl group, naphthyl group, alkylaryl groups in which at least one alkyl group is added to these groups as a substituent, and arylalkyl groups in which aryl groups such as phenyl and naphthyl groups are added to alkyl groups as substituents.

Though the number of carbons in the hydrocarbon group containing an aromatic ring represented by $R^1$ is not limited in particular, one with a carbon number of 7 to 12 is preferably used. Specific examples of the hydrocarbon group containing an aromatic ring with such a carbon number include toluyl group, xylyl group, β-phenacyl group, t-butylphenyl group, dodecylphenyl group, benzyl group, and methylbenzyl group.

$R^2$ in general formulas (1) to (3) is a divalent hydrocarbon group (preferably with a carbon number of 6 to 20, a carbon number of 6 to 15 in particular). Examples of such a hydrocarbon group include linear or branched alkylene groups, linear or branched alkenylene groups, cycloalkylene groups, and aromatic groups. Among them, ethylene group, 2,2-dimethyl-4-methylhexylene group, and groups represented by the following formulas (6) to (14) are preferred, the groups represented by the formulas (7) and (9) in particular:

(6)

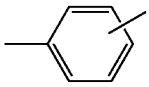

(7)

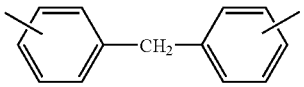

(8)

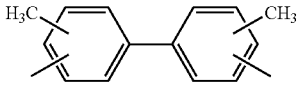

-continued (9)

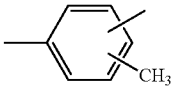

(10)

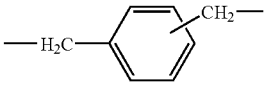

(11)

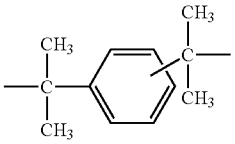

(12)

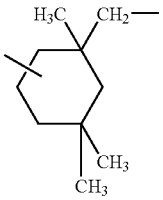

(13)

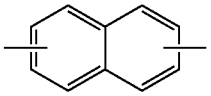

(14)

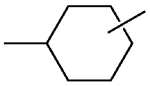

In general formulas (2) and (3), $R^3$ is a hydrocarbon group containing an aliphatic ring. Though the number of carbons contained in the hydrocarbon group containing an aliphatic ring represented by $R^3$ is not restricted in particular, one with a carbon number of 7 to 12 is preferably used.

As the hydrocarbon group containing an aliphatic ring represented by $R^3$, cyclohexyl group or alkylcyclohexyl group is preferably used. Specific examples include methylcyclohexyl group, dimethylcyclohexyl group, ethylcyclohexyl group, diethylcyclohexyl group, propylcyclohexyl group, isopropylcyclohexyl group, 1-methyl-3-propylcyclohexyl group, butylcyclohexyl group, pentylcyclohexyl group, pentylmethylcyclohexyl group, and hexylcyclohexyl group, among which cyclohexyl group, methylcyclohexyl group, dimethylcyclohexyl group, and ethylcyclohexyl group are more preferable.

The respective contents of the diurea compounds represented by general formulas (1) to (3) are required to satisfy the conditions represented by the following expressions (4) and (5):

$$5 \leqq W_1+W_2+W_3 \leqq 30 \quad (4)$$

$$0.3 \leqq (W_1+0.5\times W_2)/(W_1+W_2+W_3) \leqq 0.7 \quad (5)$$

where $W_1$, $W_2$, and $W_3$ are respective contents (each expressed by the unit of mass %) of the diurea compounds represented by general formulas (1) to (3) based on the total amount of the grease composition.

As expression (4) shows, the sum $W_1+W_2+W_3$ of contents of the diurea compounds represented by general formulas (1) to (3) is 5 to 30 mass % based on the total amount of the grease composition. When the sum $W_1+W_2+W_3$ is less than 5 mass %, the effect of the thickener is so weak that the composition fails to become sufficiently greasy. For the same reason, $W_1+W_2+W_3$ is preferably at least 10 mass %. When $W_1+W_2+W_3$ exceeds 30 mass %, the composition becomes too hard as a grease, thereby failing to exhibit a sufficient lubricating property. For the same reason, $W_1+W_2+W_3$ is preferably 20 mass % or less.

When $(W_1+0.5\times W_2)/(W_1+W_2+W_3)$ in expression (5) is less than 0.3, the resistance to fretting deteriorates. For the same reason, $(W_1+0.5\times W_2)/(W_1+W_2+W_3)$ is preferably at least 0.35, more preferably at least 0.4, further preferably at least 0.45. Also, the resistance to fretting deteriorates when $(W_1+0.5\times W_2)/(W_1+W_2+W_3)$ exceeds 0.7. For the same reason, $(W_1+0.5\times W_2)/(W_1+W_2+W_3)$ is preferably not greater than 0.6, more preferably less than 0.5.

For example, these diurea compounds are obtained when a diisocyanate represented by the general formula of OCN—$R^2$—NCO and amines represented by the general formulas of $R^1$—$NH_2$ and $R^3$—$NH_2$ are caused to react against each other at a temperature of 10° to 200° C. in the base oil. Here, $R^1$, $R^2$, and $R^3$ correspond to those of (1) to (3), respectively.

Also, the diurea compounds may be a mixture of a reaction product of diisocyanate and the amine represented by $R^1$—$NH_2$, and a reaction product of diisocyanate and the amine represented by $R^3$—$NH_2$; or a reaction product of diisocyanate and a mixture of the amine represented by $R^1$—$NH_2$ and the amine represented by $R^3$—$NH_2$.

The grease composition of the present invention further contains at least one species of compound selected from the group consisting of paraffin oxides and phosphorus compounds in addition to the above-mentioned lubricant base oil and diurea compounds.

Examples of the paraffin oxides used in the present invention include paraffin oxide, salts of paraffin oxide, and esters of paraffin oxide. Examples of paraffin oxide mentioned here include those obtained by oxidizing petroleum waxes such as paraffin wax, microcrystalline wax, and slack wax, or a synthetic wax such as polyolefin wax. Examples of the salts of paraffin oxide include alkali metal salts, alkaline earth metal salts, and amine salts of paraffin oxide. Examples of the esters of paraffin oxide include esters formed between an alcohol (most preferably methanol) having a carbon number of 1 to 24 (preferably 1 to 12, more preferably 1 to 6) and paraffin oxide. The paraffin oxides used in the present invention may have any properties. However, from the viewpoint of the resistance to fretting, their melting point is preferably at least 25° C., more preferably 30° C., but preferably not higher than 110° C., more preferably not higher than 70° C. The total acid number is preferably at least 0.2 mgKOH/g, more preferably at least 1 mgKOH/g, but preferably not greater than 65 mgKOH/g, more preferably not greater than 40 mgKOH/g.

Specific examples of the phosphorus compounds include phosphate esters, acid phosphate esters, amine salts of acid phosphate esters, chlorinated phosphate esters, phosphite esters, and thiophosphate esters. These phosphorus compounds are esters formed between phosphoric acid, phosphorous acid, or thiophosphoric acid and an alkanol or polyether alcohol, or their derivatives.

More specific examples of phosphate esters include tributyl phosphate, tripentyl phosphate, trihexyl phosphate, triheptyl phosphate, trioctyl phosphate, trinonyl phosphate, tridecyl phosphate, triundecyl phosphate, tridodecyl phosphate, tritridecyl phosphate, tritetradecyl phosphate, tripentadecyl phosphate, trihexadecyl phosphate, triheptadecyl phosphate, trioctadecyl phosphate, trioleyl phosphate, triphenyl phosphate, tricresyl phosphate, trixylenyl phosphate, cresyldiphenyl phosphate, and xylenyldiphenyl phosphate.

Examples of the acid phosphate esters include monobutyl acid phosphate, monopentyl acid phosphate, monohexyl acid phosphate, monoheptyl acid phosphate, monooctyl acid phosphate, monononyl acid phosphate, monodecyl acid phosphate, monoundecyl acid phosphate, monododecyl acid phosphate, monotridecyl acid phosphate, monotetradecyl acid phosphate, monopentadecyl acid phosphate, monohexadecyl acid phosphate, monoheptadecyl acid phosphate, monooctadecyl acid phosphate, monooleyl acid phosphate, dibutyl acid phosphate, dipentyl acid phosphate, dihexyl acid phosphate, diheptyl acid phosphate, dioctyl acid phosphate, dinonyl acid phosphate, didecyl acid phosphate, diundecyl acid phosphate, didodecyl acid phosphate, ditridecyl acid phosphate, ditetradecyl acid phosphate, dipentadecyl acid phosphate, dihexadecyl acid phosphate, diheptadecyl acid phosphate, dioctadecyl acid phosphate, and dioleyl acid phosphate.

Examples of the amine salts of acid phosphate esters include salts formed between the acid phosphate esters and amines such as methylamine, ethylamine, propylamine, butylamine, pentylamine, hexylamine, heptylamine, octylamine, dimethylamine, diethylamine, dipropylamine, dibutylamine, dipentylamine, dihexylamine, diheptylamine, dioctylamine, trimethylamine, triethylamine, tripropylamine, tributylamine, tripentylamine, trihexylamine, triheptylamine, and trioctylamine.

Examples of the chlorinated phosphate esters include tris(dichloropropyl)phosphate, tris(chloroethyl)phosphate, tris(chlorophenyl)phosphate, and polyoxyalkylene bis[di(chloroalkyl)]phosphate.

Examples of the phosphite esters include phosphite diesters such as dibutyl hydrogen phosphite, dipentyl hydrogen phosphite, dihexyl hydrogen phosphite, diheptyl hydrogen phosphite, dioctyl hydrogen phosphite, dinonyl hydrogen phosphite, didecyl hydrogen phosphite, diundecyl hydrogen phosphite, didodecyl hydrogen phosphite, dioleyl hydrogen phosphite, diphenyl hydrogen phosphite, and dicresyl hydrogen phosphite; and phosphite triesters such as tributyl phosphite, tripentyl phosphite, trihexyl phosphite, triheptyl phosphite, trioctyl phosphite, trinonyl phosphite, tridecyl phosphite, triundecyl phosphite, tridodecyl phosphite, trioleyl phosphite, triphenyl phosphite, and tricresyl phosphite.

Examples of phosphorothionate include tributyl phosphorothionate, tripentyl phosphorothionate, trihexyl phosphorothionate, triheptyl phosphorothionate, trioctyl phosphorothionate, trinonyl phosphorothionate, tridecyl phosphorothionate, triundecyl phosphorothionate, tridodecyl phosphorothionate, tritridecyl phosphorothionate, tritetradecyl phosphorothionate, tripentadecyl phosphorothionate, trihexadecyl phosphorothionate, triheptadecyl phosphorothionate, trioctadecyl phosphorothionate, trioleyl phosphorothionate, triphenyl phosphorothionate, tricresyl phosphorothionate, trixylenyl phosphorothionate, cresyldiphenyl phosphorothionate, xylenyldiphenyl phosphorothionate, tris(n-propylphenyl)phosphorothionate, tris(isopropylphenyl)phosphorothionate, tris(n-butylphenyl)phosphorothionate, tris(isobutylphenyl)phosphorothionate, tris(s-butylphenyl)phosphorothionate, and tris(t-butylphenyl)phosphorothionate.

The above-mentioned phosphorus compounds may be used one by one or in a mixture of two or more.

Among them, because of better resistance to fretting, phosphite esters are preferable, phosphite diesters are more preferable, and diphenyl hydrogen phosphite is further preferable.

The total content of the paraffin oxides and phosphorus compounds is preferably at least 0.5 mass %, more preferably at least 1.0 mass %, based on the total amount of the grease composition. When the content is less than 0.5 mass %, the resistance to fretting tends to become insufficient in the grease. On the other hand, the content is preferably not greater than 15 mass %, more preferably 10 mass %. When the content exceeds 15 mass %, the resistance to fretting cannot be obtained in proportion to the amount of addition.

For improving performances, the grease composition of the present invention can further contain solid lubricants, extreme pressure agents, antioxidants, oily agents, antirusts, viscosity index improvers, etc. when necessary as long as its properties do not deteriorate.

Specific examples of the solid lubricants include graphite, graphite fluoride, polytetrafluoroethylene, molybdenum disulfide, antimony sulfide, and alkali (earth) metal borates.

Specific examples of the extreme pressure agents include organic zinc compounds such as zinc dialkyldithiophosphate and zinc diaryldithiophosphate; and sulfur-containing compounds such as dihydrocarbyl polysulfide, sulfide esters, thiazole compounds, and thiadiazole compounds.

Specific examples of the antioxidants include phenol type compounds such as 2,6-di-t-butylphenol and 2,6-di-t-butyl-p-cresol; amine type compounds such as dialkyldiphenylamine, phenyl-α-naphthylamine, and p-alkylphenyl-α-naphthylamine; sulfur type compounds; and phenothiazine type compounds.

Specific examples of the oily agents include amines such as laurylamine, myristylamine, palmitylamine, stearylamine, and oleylamine; higher alcohols such as lauryl alcohol, myristyl alcohol, palmityl alcohol, stearyl alcohol, and oleyl alcohol; higher fatty acids such as lauric acid, myristic acid, palmitic acid, stearic acid, and oleic acid; fatty acid esters such as methyl laurate, methyl myristate, methyl palmitate, methyl stearate, and methyl oleate; amides such as laurylamide, myristylamide, palmitylamide, stearylamide, and oleylamide; and fats and oils.

Specific examples of the antirusts include metal soaps; polyhydric alcohol partial esters such as sorbitan fatty acid esters; amines; phosphoric acid; and phosphates.

Specific examples of the viscosity index improvers include polymethacrylate, polyisobutylene, and polystyrene.

The grease composition of the present invention can be prepared, for example, by mixing and stirring the diurea compounds represented by general formulas (1) to (3) and at least one species of compound selected from the group consisting of paraffin oxides and phosphorous compounds, together with other additives if necessary, with a lubricant base oil; and passing thus obtained mixture through a roll mill or the like. The grease composition can also be made by adding the material components of the diurea compounds represented by general formulas (1) to (3) to the lubricant base oil beforehand; melting them together; stirring and mixing them so as to prepare the diurea compounds; then mixing and stirring them with at least one species of compound selected from the group consisting of paraffin oxides and phosphorus compounds, together with other additives if necessary; and passing thus obtained mixture through a roll mill or the like.

The grease composition of the present invention is excellent in fretting wear (micromotion wear) prevention, and thus is useful as a grease for sliding parts, joint parts, etc. in elements aimed at restricting relative motion and in elements susceptible to minute reciprocation, and is preferably used in particular in shaft engaging parts, bolt joint parts, rivet joint parts, tapered couplings, rolling bearings, sliding bearings, ball bushings, spline shafts, flexible shaft couplings, universal joints, constant velocity joints, leaf springs, coil springs, electric contacts, valves with valve seats, and wire ropes.

EXAMPLES

In the following, details of the present invention will be explained more specifically with reference to examples and comparative examples. However, the following examples do not restrict the present invention at all.

Examples 1 to 3 and Comparative Examples 1 to 4

Using poly-α-olefin (having a kinetic viscosity of 48 $mm^2/s$ at 40° C.) or paraffin mineral oil (having a kinetic viscosity of 126 $mm^2/s$ at 40° C.) as a lubricant base oil, diphenylmethane-4,4'-diisocyanate (MDI) was dissolved into the base oil by heating, and monoamines listed in Table 1, each dissolved in the base oil, were added thereto. Various additives listed in the following were added to thus generated gel-like material, so as to yield the compositions shown in Table 1, and after stirring, the resulting mixtures were passed through a roll mill, so as to yield the grease compositions of Examples 1 to 3 and Comparative Examples 1 to 4. When preparing the grease compositions, the total thickener amount was adjusted such that they exhibited the same level of consistency after the lapse of 1 day from the making. The values of $W_1+W_2+W_3$ and $(W_1+0.5\times W_2)/(W_1+W_2+W_3)$ in thus obtained grease compositions are shown in Table 1. In Table 1, the cell for $W_1+W_2+W_3$ in Comparative Example 4 shows the total thickener amount instead of $W_1+W_2+W_3$.

Additives:

paraffin oxide (paraffin oxide ester (ester formed between paraffin oxide obtained by oxidizing slack wax and methanol, with a total acid number of 33 mgKOH/g and a saponification number of 130 mgKOH/g))

phosphorus compound (dihydrogen phosphite)

Fretting Resistance Test

Using a Fafnir friction oxidation tester, a fretting resistance test was carried out for each of the grease compositions of Examples 1 to 3 and Comparative Examples 1 to 4 in conformity to ASTM D4170, so as to measure the amount of wear. Using a thrust bearing 51204 (manufactured by NSK Ltd.) as a bearing, the test was conducted for 2 hours at room temperature. In this test, the grease compositions made 1 day before were used as samples. Table 1 shows the results.

Measurement of Consistency

For each of the grease compositions of Examples 1 to 3 and Comparative Examples 1 to 4, consistency was measured after the lapse of 1 day from the making and after the lapse of 3 months from the making. Table 1 shows the results.

TABLE 1

| | Example 1 | Example 2 | Example 3 | Comparative Example 1 | Comparative Example 2 | Comparative Example 3 | Comparative Example 4 |
|---|---|---|---|---|---|---|---|
| Thickener | | | | | | | |
| MDI[mol] | 5 | 5 | 5 | 5 | 5 | 5 | 5 |
| monoamine [mol] | | | | | | | |
| p-toluidine | 3 | 4.8 | 7 | 2 | 8 | 4.8 | — |
| cyclohexylamine | 7 | 5.2 | 3 | 8 | 2 | 5.2 | 4 |
| octadecylamine | — | — | — | — | — | — | 4 |
| dicyclohexylamine | — | — | — | — | — | — | 2 |
| $W_1+W_2+W_3$ [mass %] | 18 | 18 | 18 | 20 | 18 | 18 | (10) |
| $\frac{(W_1+0.5\times W_2)}{(W_1+W_2+W_3)}$ | 0.3 | 0.48 | 0.7 | 0.2 | 0.8 | 0.48 | 0 |
| Base oil | | | | | | | |
| PAO [mass %] | 78 | — | 80 | — | — | — | — |
| paraffin mineral oil [mass %] | — | 80 | — | 78 | 78 | 79 | 86 |
| Additive | | | | | | | |
| paraffin oxide [mass %] | 3 | 1.5 | 1 | 1.5 | 1.5 | — | 1.5 |
| phosphorus compound [mass %] | 1 | 0.5 | 1 | 0.5 | 0.5 | — | 0.5 |
| Consistency (60W) | | | | | | | |
| 1 day after making | 285 | 277 | 293 | 289 | 296 | 280 | 290 |
| 3 months after making | 279 | 272 | 297 | 281 | 294 | 283 | 238 |
| Amount of wear [mg] | 0.9 | 0.2 | 0.5 | 3.6 | 3.1 | 2.4 | 0.7 |

As shown in Table 1, it was verified that the grease compositions of Examples 1 to 3 were excellent in viscosity stability and resistance to fretting.

By contrast, as shown in Table 1, the resistance to fretting was insufficient in the grease compositions of Comparative Examples 1 to 3 even immediately after the making. The grease composition of Comparative Example 4 exhibited a relatively favorable resistance to fretting immediately after the making, but lowered its consistency and became harder after the lapse of 3 months.

Industrial Applicability

As explained in the foregoing, by adding the diurea compounds represented by general formulas (1) to (3) and at least one species selected from the group consisting of paraffin oxides and phosphorus compounds at their respective specific compounding ratios, the grease composition of the present invention can attain an excellent resistance to fretting and become less likely to harden. Therefore, the grease composition of the present invention is quite useful as a grease for sliding parts, joint parts, etc. in elements aimed at restricting relative motion and in elements susceptible to minute reciprocation.

The invention claimed is:

1. A grease composition containing a lubricant base oil, diurea compounds represented by the following general formulas (1) to (3), an ester of paraffin oxide having a total acid number of 0.2-65 mgKOH/g and at least one phosphite ester selected from phosphite diesters; wherein respective contents of the diurea compounds represented by the following general formulas (1) to (3) satisfy conditions defined by the following expressions (4) and (5); and wherein the total content of the ester of pamraffin oxide and the phosphite ester is not greater than 4.5 mass %, the content of the ester of paraffin oxide is at least the 1 mass %, and the content of the phosphite ester is 0.5 mass % to 1.0 mass % based on the total amount of the grease composition:

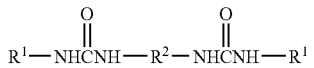

(1)

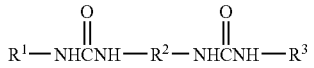

(2)

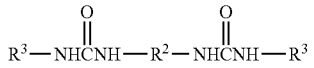

(3)

where $R^1$ is a hydrocarbon group containing an aromatic ring, $R^2$ is a divalent hydrocarbon group, and $R^3$ is a hydrocarbon group containing an aliphatic ring;

$$10 \leqq W_1+W_2+W_3 \leqq 20 \quad (4)$$

$$0.3 \leqq (W_1+0.5\times W_2)/(W_1+W_2W_3) \leqq 0.7 \quad (5)$$

where $W_1$, $W_2$, and $W_3$ are respective contents (mass %) of the diurea compounds represented by general formulas (1) to (3) based on the total amount of the grease composition.

2. The grease composition according to claim 1, wherein the ester of paraffin oxide is formed between an alcohol having a carbon number of 1 to 24 and paraffin oxide.

3. The grease composition according to claim 1, wherein the total acid number of the ester of paraffin oxide is 1 to 40 mgKOH/g.

* * * * *